US006877925B2

(12) United States Patent
Fernandez

(10) Patent No.: US 6,877,925 B2
(45) Date of Patent: Apr. 12, 2005

(54) PAINT ROLLING SYSTEM

(75) Inventor: Juan Fernandez, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 2 days.

(21) Appl. No.: 10/190,760

(22) Filed: Jul. 8, 2002

(65) Prior Publication Data

US 2003/0148036 A1 Aug. 7, 2003

Related U.S. Application Data

(60) Provisional application No. 60/353,524, filed on Feb. 1, 2000.

(51) Int. Cl.[7] ..... B05C 17/025
(52) U.S. Cl. ..... 401/197
(58) Field of Search ..... 401/197, 196, 401/218–220, 208, 147, 148, 203; 15/248.1, 248; 429/13, 15

(56) References Cited

U.S. PATENT DOCUMENTS 2,708,763 A * 5/1955 Jacoby ..... 401/194
2,849,157 A * 8/1958 Remien, Jr. ..... 222/169
3,877,823 A * 4/1975 Leland ..... 401/197
4,032,238 A * 6/1977 Leland ..... 401/195
5,090,084 A * 2/1992 De Guzman ..... 15/230.1
5,463,789 A * 11/1995 Zilinski ..... 15/248.2

OTHER PUBLICATIONS

Instruction sheets for Paint Runner, 2 pages.

* cited by examiner

*Primary Examiner*—Gregory Huson
*Assistant Examiner*—Huyen Le
(74) *Attorney, Agent, or Firm*—Lerner, David, Littenberg Krumholz & Mentlik, LLP

(57) ABSTRACT

A paint roller having a reservoir for holding paint is disclosed. The paint roller has a handle, an outer section connected to the handle that has openings in it and an inner section with a plurality of openings that fits concentrically within the outer section. The outer section and the inner section can be rotated relative to each other so that the openings in the outer section and in the inner section align in varying degrees so as to meter the amount of paint dispersed from the reservoir. An edger can also fit on the end of the paint roller. The invention also includes a tray with a depression suitable for storing the paint roller and which may be turned over and utilized to support the paint roller while the paint roller is filled with paint.

48 Claims, 17 Drawing Sheets

PAINT ROLLING SYSTEM

CROSS-REFERENCE TO RELATED APPLICATIONS

This application claims the benefit of U.S. Provisional application No. 60/353,524 filed on Feb. 1, 2002, the disclosure of which is incorporated herein by reference.

BACKGROUND OF THE INVENTION

The present invention relates to paint rolling tools and appurtenances that are utilized to apply paint to objects.

A paint roller and pan are frequently used by both professionals and do-it-yourselfers for many different painting applications, and techniques for using both rollers and pans are well-known in the art. These simple tools are often the best available tools for painting particular objects, such as walls.

When using a paint roller and pan, however, both the pan and the paint roller must be replenished with paint on a frequent basis. This is time consuming, and results in an inefficient way of applying paint to objects. As a result, it has been suggested to include a reservoir for paint within the paint roller tool itself. The prior methods, however, are ineffective, inefficient, difficult to maintain and difficult to use. Accordingly, new paint roller devices and methods of operation are needed.

SUMMARY OF THE INVENTION

In accordance with the present invention, a paint roller has a handle with a generally U-shaped bar extending from the handle. An outer roller section is secured around an end of the generally U-shaped bar such that the outer roller section can be rotated. An inner roller section fits concentrically within the outer roller section. The inner roller section provides a cavity or a reservoir in which paint can be held in the paint roller. It is preferred to provide agitator blades within the inner roller that extend into the cavity or reservoir to mix the paint while inside the reservoir of the paint roller.

The outer roller section and the inner roller section each have a plurality of openings, which are preferably equally sized slots, in their cylindrical surfaces. The outer roller section can be rotated through a limited range of degrees relative to the inner roller section such that the openings in the surfaces align in varying amounts. Such alignment provides passageways from the reservoir in the paint roller to the exterior of the outside roller's cylindrical surface.

The alignment of the openings in the outer roller section and the openings in the inner roller section can be full alignment, whereby the openings align completely to allow the maximum amount of paint to be dispensed from the paint roller. The alignment of the openings in the two sections can also be of partial alignment, whereby the amount of paint to be dispensed from the paint roller is metered in accordance with the degree of alignment. The outer roller section can also be rotated relative to the inner roller section such that there is no alignment of the openings. This prevents paint from dispensing from the paint roller. In preferred embodiments, the rotation adjustment positions of the inner roller relative to the outer roller may be predetermined by various means. Such means include a series of notches, or dimples, cast in the inner roller's cylindrical inner surface in which a protrusion from the outer roller's cylindrical outer surface may lie. A sealed cap fits over the end of the inner roller section to contain paint within the cavity or reservoir inside the paint roller. In preferred embodiments, the cap includes an integral funnel member.

A paint applicator cover is typically fitted over the outer roller section when the paint roller is used, thereby allowing the paint to be effectively applied to an object. This paint applicator cover may be any number of such items commercially available and known in the art. The key element of the cover, however, is that paint applicator be porous to permit paint to flow from its interior through to its exterior. While the cover may be permanently affixed, it is preferred that the cover be removable, as removable covers are easier to clean. In addition, removable covers enable the user to choose a cover with the best characteristics for the surface being patented. For example, it is well known that a rough surface requires a highly napped roller while a smooth surface does not.

A square edger device may also be attached to the paint roller, preferably over the sealed cap. An edger allows the paint roller device to effectively and efficiently apply paint to walls against edged objects, such as window frames and door jambs.

The present invention may also include a tray that is used both for shipping/storage of the roller device, and to facilitate filling of the inner roller with paint. As a shipping/storage device, the tray is provided with recesses registered to the shape of the paint roller unit, including the handle and all accessories. The roller unit may be placed in such recesses for shipping or safekeeping. When turned over, these same recesses support the roller unit to help facilitate filling of the unit with paint.

The tray also includes a removable portion, which may be adapted to be used as a funnel. The funnel portion tapers down to a shape that corresponds with the funnel portion of the end cap of preferred embodiments of the present invention. The tray's underside includes a portion, which may be adapted to support the roller assembly to facilitate filling of the inner roller with paint. In its use to facilitate filling, the tray's funnel portion is removed and the tray is flipped to reveal its underside. The roller assembly is then secured onto the tray. A protective cap is then removed from the end cap and the funnel portion is inserted in its absence. Paint may thereafter be delivered through the funnel to fill the inner roller's reservoir in a neat, quick and controlled manner. Upon filling of the reservoir, the funnel may be removed and protective cap replaced, rendering the paint roller ready for service.

The present invention also includes methods of painting. As an example, one may provide a painting tool for dispensing paint comprising a handle and an outer roller section connected to the handle. The outer roller section will have a cylindrical surface with a plurality of openings. Within the outer roller section, there is placed an inner roller section having a cylindrical surface with a plurality of openings. The outer roller section may be rotated relative to the inner roller section so that the plurality of openings in the cylindrical surfaces may align with each other to varying degrees. The method also includes filling the inner roller with paint and manipulating the painting tool so as to paint the surface. The method may also include placing a paint applicator cover over the outer roller prior to painting the surface. It may also be advantageous to selectively rotate the outer roller section relative to the inner roller section to select a level of opening overlap to cause the desired amount of paint to be released from the painting tool upon use. A cap may also be placed on the open outer end of the painting tool. Finally, the method may include use of a storage tray to facilitate filling of the roller.

DESCRIPTION OF THE PREFERRED EMBODIMENT

Figure 1:
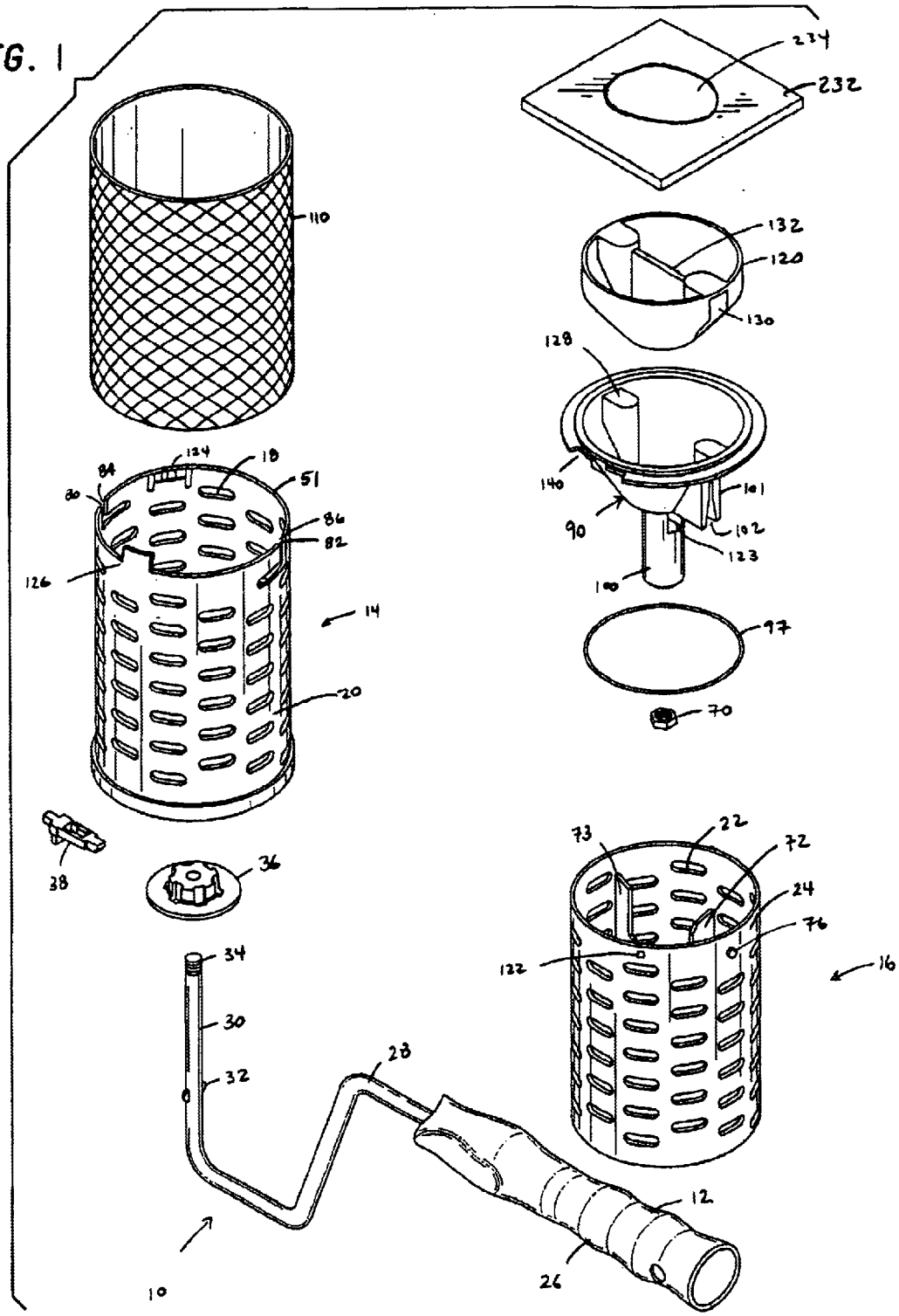
FIG. 1 illustrates an exploded perspective view of a first embodiment of the paint roller of the present invention.

The following describes exemplary embodiments of the paint roller of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

Referring to the figures, FIG. 1 shows an exploded perspective view of a paint roller in accordance with the first, and preferred, embodiment of the present invention.

Figure 3:
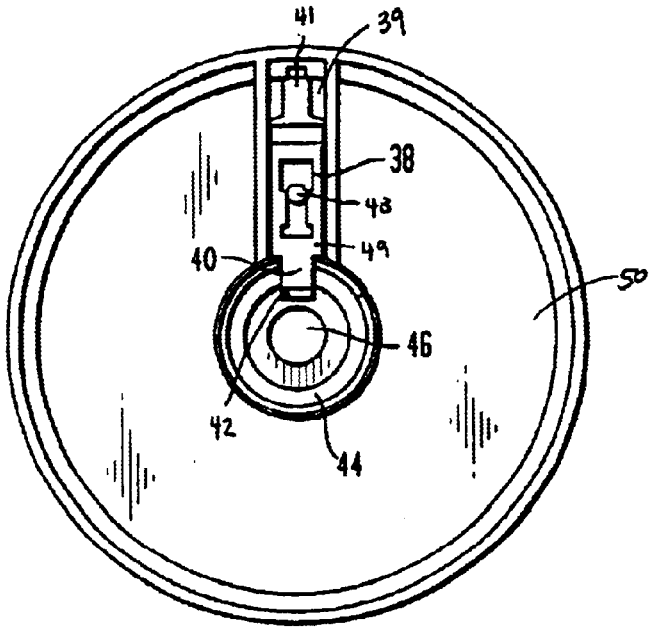
FIG. 3 depicts a frontal elevational view of the walled end of the outer roller of the present invention.

Referring to FIG. 1, an exploded view of a paint roller 10 is shown. The paint roller 10 includes a handle 12, an outer roller section 14 and an inner roller section 16. The outer roller section 14 has a plurality of openings 18 in its cylindrical outer surface 20. Likewise, the inner roller section 16 has a plurality of openings 22 in its cylindrical outer surface 24. Each of the plurality of openings 18 and 22 can be made of a variety of sizes and shapes. However, it is preferred that the plurality of openings 18 in the outer roller section 14 be the same size and shape as the plurality of openings 22 in the inner roller section 16. It is further preferred that the plurality of openings 18 and 22 be in the shape of slots. In addition, the outer roller contains a walled end 50 (see FIG. 3) and an open end 51 (see FIG. 8), within which the inner roller 16 may be placed.

The handle 12 includes an enlarged plastic section 26 that is ergonomically fitted to a typical painter's hand. A generally U-shaped, metal bar 28 extends from the handle 12. The bar 28 includes a shaft 30 that forms one end of the bar 28, away from the handle 12. The shaft 30 includes a plurality of tabs 32 located at the end of the shaft 30 nearest the handle 12, and is threaded on the extreme other end 34.

Figure 4:
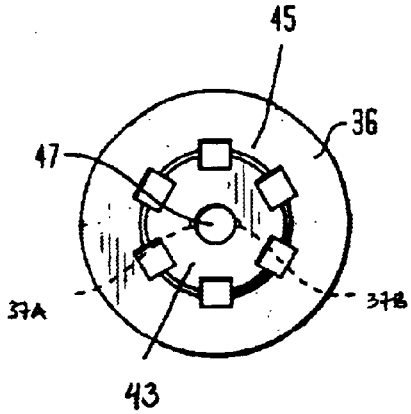
FIG. 4 depicts a frontal elevational view of a stopper ring of the present invention.
Figure 5:
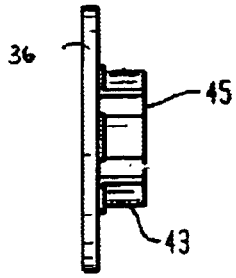
FIG. 5 illustrates a side elevational view of the stopper ring of FIG. 4.

A stopper ring 36 and a stopper 38 provide a means for controlling the rotation of the outer roller section 14 relative to the handle 12. The stopper ring 36 and the stopper 38 are shown in greater detail in FIGS. 3, 4 and 5. The stopper ring 36 has two openings 37A and 37B that extend partially into the stopper ring 36, and which are sized and positioned to engage the tabs 32 on the shaft 30. This prevents the stopper ring 36 from rotating about the shaft.

The stopper 38 fits in a channel 39 on the walled end 50 of the outer roller section 14. The stopper 38 has a knob 40 on one of its ends and a lip 41 on the other of its ends. The stopper ring contains a circular area 47 and the walled end contains a corresponding circular area 46. These areas are open so that the shaft 30 may be inserted therethrough.

When it is desired to stop rotation of the paint roller, a user presses the protruding lip 41 on the stopper toward the center of the paint roller 10. This pushes the knob 40 into an area 42. The stopper ring 36 has a section 43 that fits into a recessed section 44 on the walled end 50 of the outer roller section 14. When the knob 40 extends into the area 42 and when the paint roller is assembled, the knob 40 may engage one of a plurality of slotted sections 45 in the stopper ring 36, which is fixed relative to the shaft 30, to prevent further rotation of the paint roller 10. When it is desired to permit rotation, the stopper 38 is pushed out from the center of the paint roller by pulling on the lip 41 so that the knob 40 no longer engages the stopper ring 36. A peg 48 extending from the wall 50 and the knobs 49 on the stopper 38 operate to keep the stopper in place, along the walled end 50.

Figure 6:
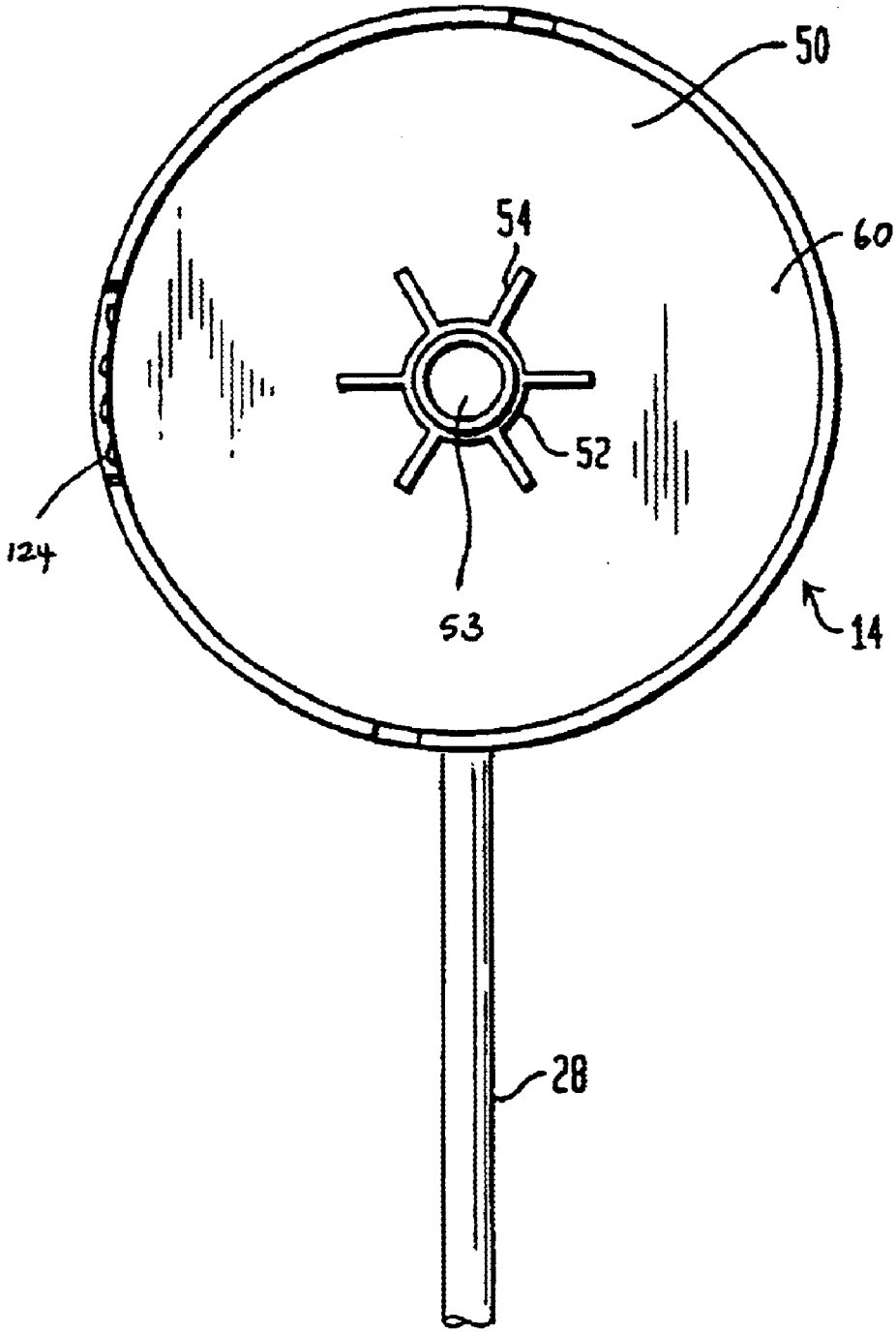
FIG. 6 illustrates a side elevational view of the paint roller of the present invention without the inside roller installed.
Figure 8:
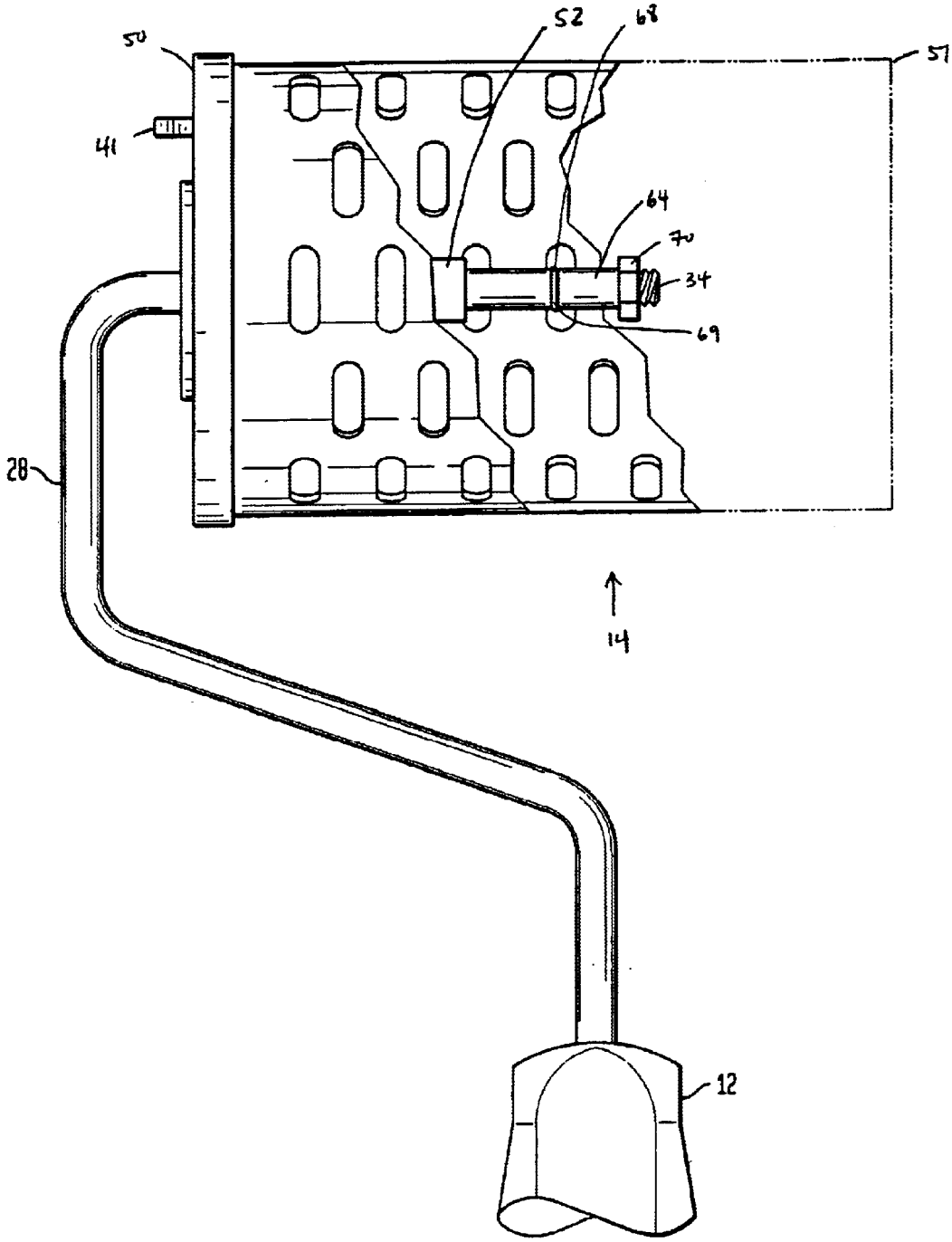
FIG. 8 illustrates a paint roller of the present invention in a partial cut away view in accordance with a first embodiment of the present invention.

Referring to FIGS. 1 and 8, the outer roller section 14 has a walled end 50 that is attached to the cylindrical surface 20. The end 51 of the outer roller section 14 opposite the walled end 50 is open. The outer roller section 14 slides onto the shaft 30, walled end 50 first and engages the stopper ring 36. A conical structure 52 extends from the walled end 50 of the outer roller section 14. The conical structure 52 has a hole 53 (see FIG. 6) extending through its center in which the shaft 30 fits. The shaft 30 is a relatively tight fit in the hole 53 so that the outer roller section 14 is held securely in the shaft 30. This fit, however, still allows the outer roller section 14 to freely rotate about the shaft.

A plurality of agitator blades 54 extend from the conical structure 52 into a reservoir 60, which is formed inside the outer roller section 14. The reservoir 60 is the voided area bounded by the cylindrical outer surface 20, the walled end 50, the conical structure 52 and the open end 51. The purpose of the reservoir 60 is to hold paint 62 (not shown) that can be placed within the paint roller 10. When the outer roller section 14 is rotated—a motion that naturally occurs when the paint roller 10 is in use—the conical structure 52 and the agitator blades 54 also rotate. This causes the agitator blades 54 to move relative to the paint 62 (not shown) inside the reservoir 60 to mix the paint contained in the reservoir.

As illustrated in FIG. 8, the conical structure 52 preferably does not extend from the walled end 50 to the opposite end 51 of the outer roller section 14. Nor does it extend the entire length of the shaft 30. Rather, the conical section extends approximately one-third of the length of the outer roller 14. The conical section 52 ends with a shaft portion 64 comprising a groove 69 within which an O-ring 68 is placed. The shaft 30 protrudes from the shaft portion 64 with its threaded end 34. A nut 70 engages the threaded portion 34 of the shaft to secure the outer roller 14 to the handle 12, in a manner that permits rotation of the outer roller 14 relative to the shaft 30.

Figure 7:
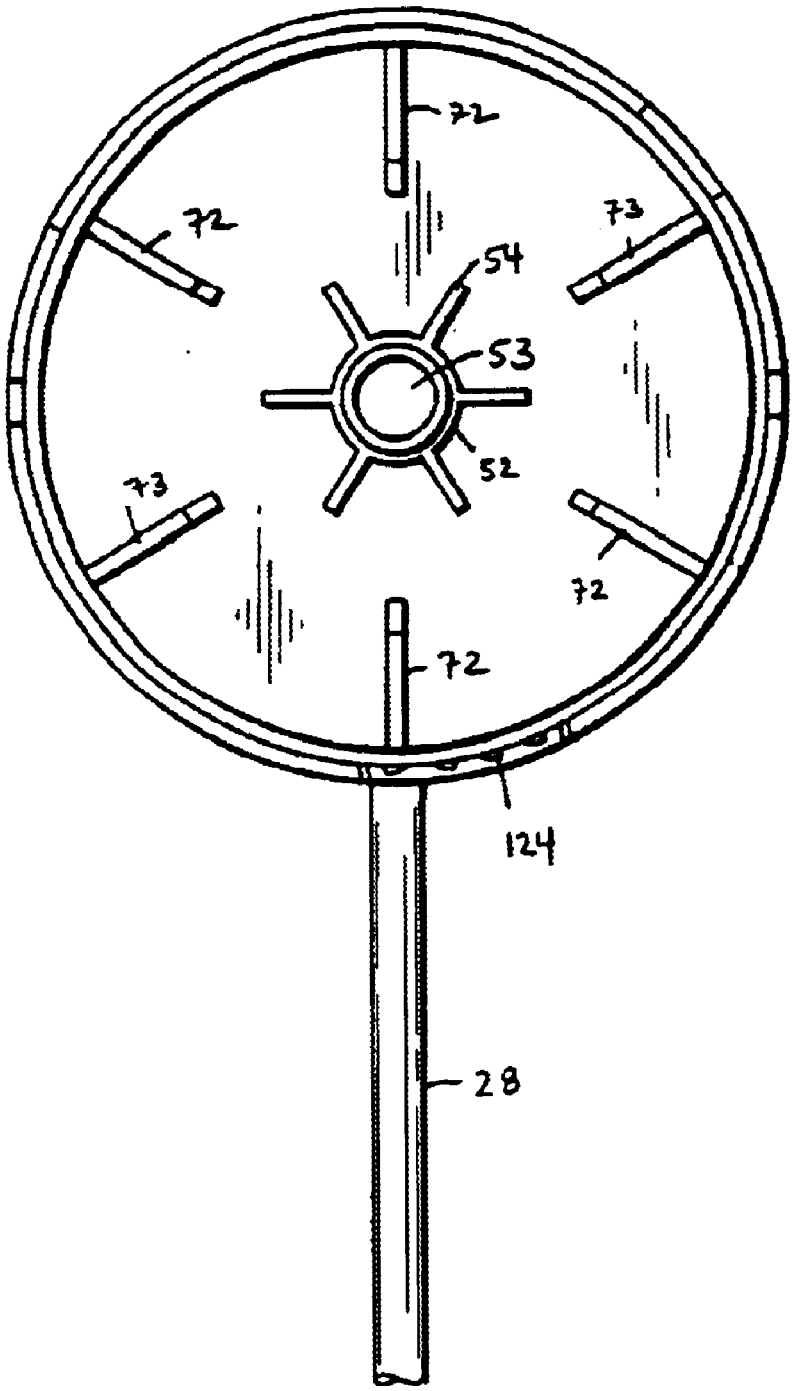
FIG. 7 illustrates a side elevational view of the paint roller of the present invention with the inside roller installed.

As illustrated in FIG. 7, the inner roller section 16 fits concentrically inside the outer roller section 14. The inner roller section 16 can also have a plurality of agitator blades 72 extending inward from its cylindrical section. When the inner roller section 16 is inside the outer roller section 14, the agitator blades 72 extend inside the reservoir 60 to further agitate any paint 62 (not shown) in the reservoir 60. The inside roller is also provided with two elongated agitator blades 73, which are designed to engage the end cap 90, as will be described hereinafter. While agitator blades 54 and the inner roller agitator blades 72 may both be provided, it is also possible to include only one of the sets of agitator blades, or to include no agitator blades at all.

As shown in FIG. 1, the inner roller section 16 preferably has two protruding knobs 76 and 78 (not shown) on opposite sides of its outer cylindrical surface 24. The outer roller section 14 preferably has two slots 80 and 82. Slot 80 has an opening 84 at the open end 51 of the outer roller section 14. The knob 76 fits through the opening 84 and into the slot 80 when the inner roller section 16 is placed concentrically inside the outer roller section 14. Similarly, slot 82 has an opening 86 at the open end 51 of the outer roller section 14. The knob 78 fits into the opening 86 when the inner roller section 16 is placed in the outer roller section 14. When the outer roller section 14 is rotated relative to the inner roller section 16, the knobs 76 and 78 slide in the slots 80 and 82. The slots 80 and 82 thereby retain the inner roller section 16 within the outer roller section 14 when the knobs 76 and 78 are in the portions of the slots 80 and 82, respectively, that are not open. The knobs 76 and 78 and the slots 80 and 82, respectively, also assist in controlling the amount of rotation of the outer roller section 16 relative to the inner roller section 14. As will be described hereinafter, the end cap 90 and outer roller tab 126 also assist with this function.

The inner roller 16 may also include a small protrusion 122 on its cylindrical outer surface 24. If so provided, then the outer roller 14 will include a series of notches 124 in registration with the small protrusion 122. The notches 124 and the protrusion 122 affect rotation of the outer roller section 14 relative to the inner roller section 16 by delimiting a number of predetermined stopping points wherein the openings 18 of the outer roller 14 and the openings 22 of the inner roller 16 align to varying degrees. For example, if four notches 124 A–D are provided, as in preferred embodiments of the present invention, then the first notch 124A will correspond to a position where the openings 18, 22 are in complete registration, and the last notch 124D will correspond to a position where the openings 18, 22 are completely closed. Therefore, the second notch 124B and the third notch 124C will correspond to intermediate positions therebetween.

It will be appreciated that if the inner roller 16 is provided with only one small protrusion 122, and the outer roller 14 is provided with only one series of notches 124, then the inner roller 16 may be placed within the outer roller 14 such that the protrusion 122 and the notches 124 either align, or do not align. For example, knob 76 of the inner roller 16 may be inserted into slot 82 of the outer roller 14 whereby the small protrusion 122 and the notches 124 align, or knob 76 may be inserted into slot 80 of the outer roller 14 whereby the small protrusion 122 and the notches 124 will not align. If the small protrusion 122 and the notches 124 do not align, then the openings 22 of the inner roller 16 and the openings 18 of the outer roller 14 may be placed in an infinite number of intermediate overlapping positions.

Figure 10:
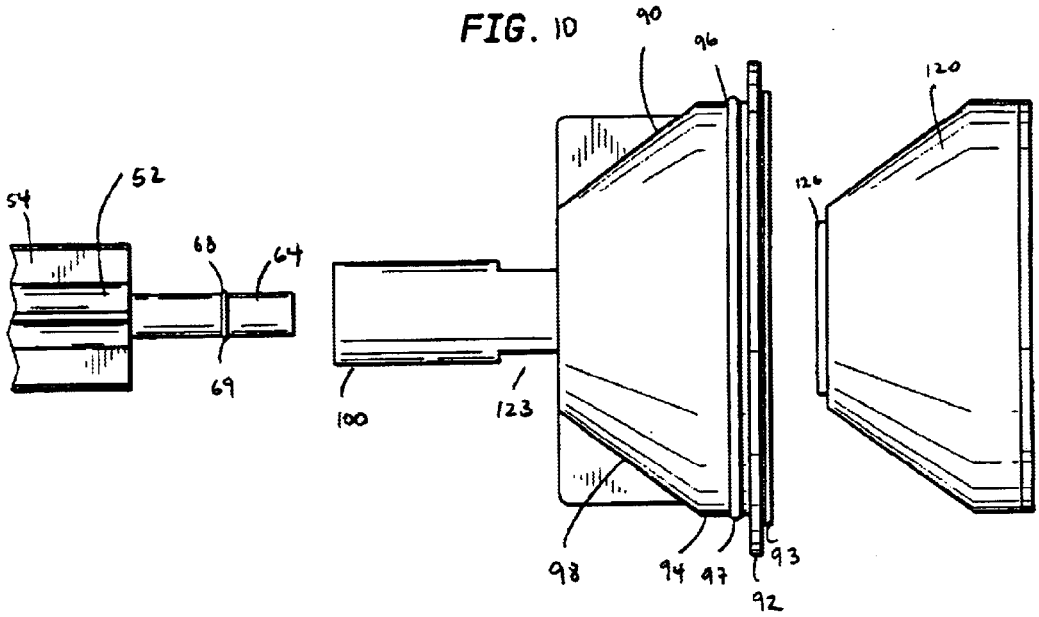
FIG. 10 illustrates an exploded side elevational view of the end cap of the paint roller in accordance with the first embodiment of the present invention.

An end cap 90 is provided to fit over the opening 51, and to thereby enclose the reservoir 60 so that paint 62 (not shown) within the reservoir 60 cannot escape the paint roller 10. The end cap 90 is illustrated in greatest detail in FIGS. 1 and 10. The end cap 90 is preferably constructed from a single piece of plastic, but contains several sections. The end cap 90 includes a first section 92 that has a diameter that is preferably greater than the diameter of the outer roller section 14, and includes a notch 93 for receiving an edger 232, as will be described hereinafter.

A second section 94 of the integrally formed end cap 90 has a diameter that is essentially the same as the inner diameter of the inner roller section 16, such that the section 94 fits snugly within the inner roller section 16 in a friction fit. The second section 94 preferably includes a groove 96 in which a rubber O-ring 97 is inserted. The snug friction fit of section 94 inside the inner roller section 16 and the rubber O-ring 97 provides a seal between the end cap 90 and the inner roller section 16 that prevents paint 62 (not shown) from escaping the reservoir 60. A third section 98 is of a generally conical configuration and extends from the second section 94. A fourth, tube-like section 100 extends from the third section 98. The third section 98 of the end cap 90 includes a pair of external wing-like protrusions 101. A channel 102 extends through each protrusion 101. Each channel 102 is preferably sized to receive one of the elongated agitator blades 73 of the inner roller 16. In the case where the agitator blades are received by the channels 102, the agitator blades would extend for most or all of the length of the inner roller section 16 so that they fit within the channels 102. This arrangement provides for a secure fit between the end cap 90 and the inner roller section 16. It also assists with rotation of the inner roller 16 relative to the outer roller 14 when the end cap 90 is rotated as will be described hereinafter.

In addition, the tube-like section 100 is adapted to engage the shaft portion 64 of the conical structure 52 of the outer roller 14. The snug friction fit of the tube-like section 100 with the shaft portion 64 and the O-ring 68 that fits in the channel 69 of the shaft portion 64 provides a seal that assists with retaining end cap 90 on the paint roller 10. It will be appreciated, however, that O-ring 68 need not be provided if so desired. The fourth section 100 includes an aperture 123, which extends into the third section 98. As will be described hereinafter, paint 62 may be permitted to flow from the exterior of the end cap 90 to the reservoir 60 when it is desirable, such as to fill the reservoir 60. This is accomplished by first removing the end cap cover 120 from within the end cap 90. The end cap cover 120 is generally conical in shape and fits snugly within the conical third section 98 of the end cap 90. Firm retention of the end cap cover 120 is accomplished by way of a friction fit between portions of the aperture 123 and a shaped rubber plug 126 provided on the end cap cover 120.

As shown in FIG. 1, the interior of the end cap 90 includes a pair of interior wing-like protrusions 128 for engaging the end cap cover 120 in the proper alignment. Accordingly, the end cap cover 120 is provided with a pair of recesses 130, for receiving the interior wing-like prosections 128. Within the end cap cover 120 and connecting the recesses 130, there is positioned a walled connector 132. The walled connector 132 permits an individual to easily grasp the end cap outer cover 120 and either place it within the end cap 90 or remove it from the end cap 90, to facilitate filling or use of the paint roller 10. The walled connector 132 also permits a user to rotate the inner roller 16 relative to the outer roller 14 to adjust the level of overlap of the respective openings 18, 22.

The first section 92 of end cap 90 includes a notched out area 140. When the end cap 90 is installed, the notched out area 140 aligns with a tab 126 provided on the open end 51 of the outer roller 14. As the inner roller 16 and the end cap 90 are rotated relative to the outer roller 14, the tab 126 is only permitted to slide within the notched out area 140. As such, the notched out area 140 provides the rotational limits of the inner roller 16 and end cap 90 relative to the outer roller 14. These limits typically equal the rotational limitation provided by the interface of the knob 76 and slot 80, and the knob 78 and slot 82, as previously described.

With the exception of the rubber plug 126, it is preferred that the end cap cover 120 be cast as a single piece of material. However, this need not be the case as the end cap cover may be constructed from multiple pieces.

Figure 2:
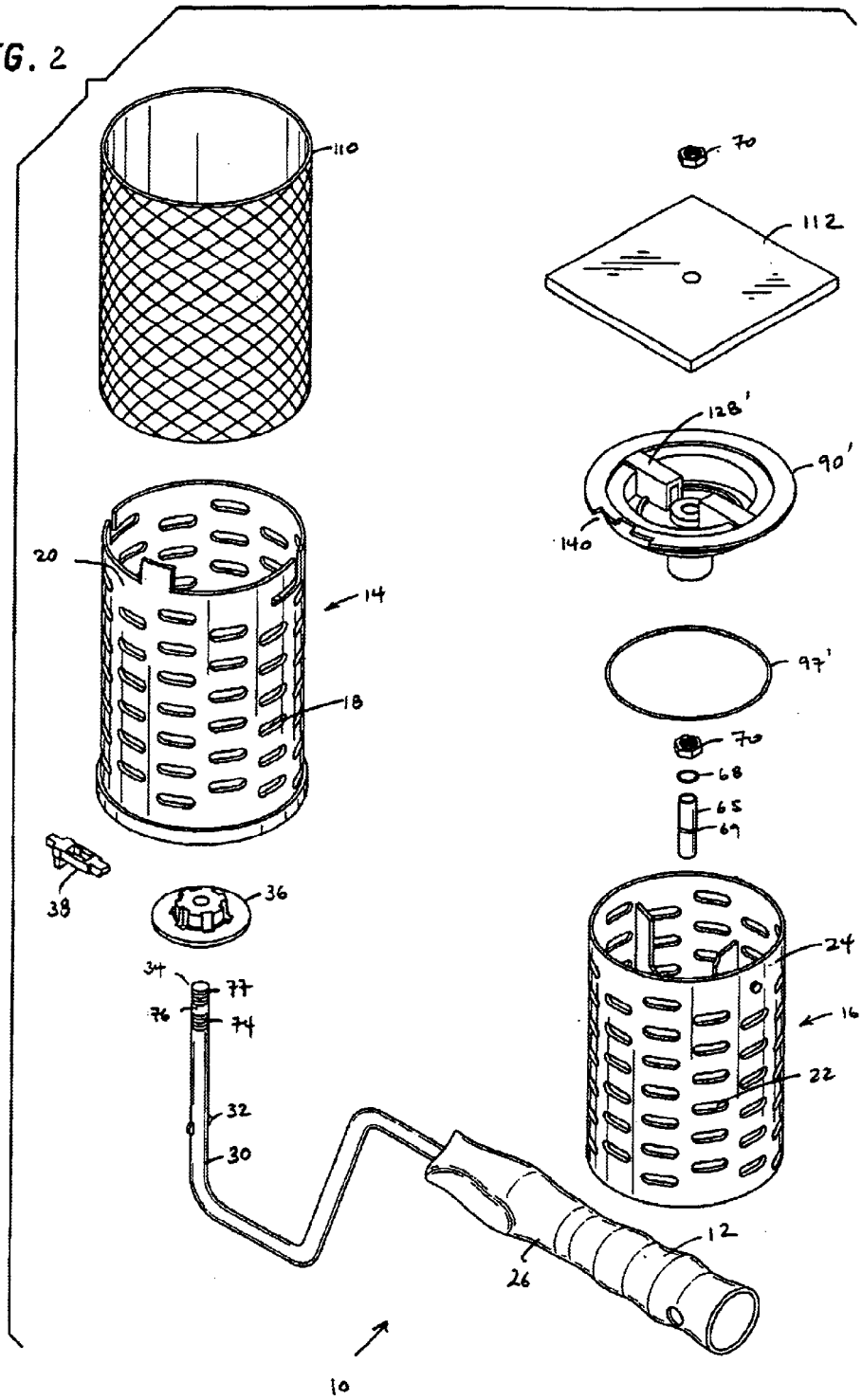
FIG. 2 illustrates an exploded perspective view of a second embodiment of the paint roller of the present invention.
Figure 9:
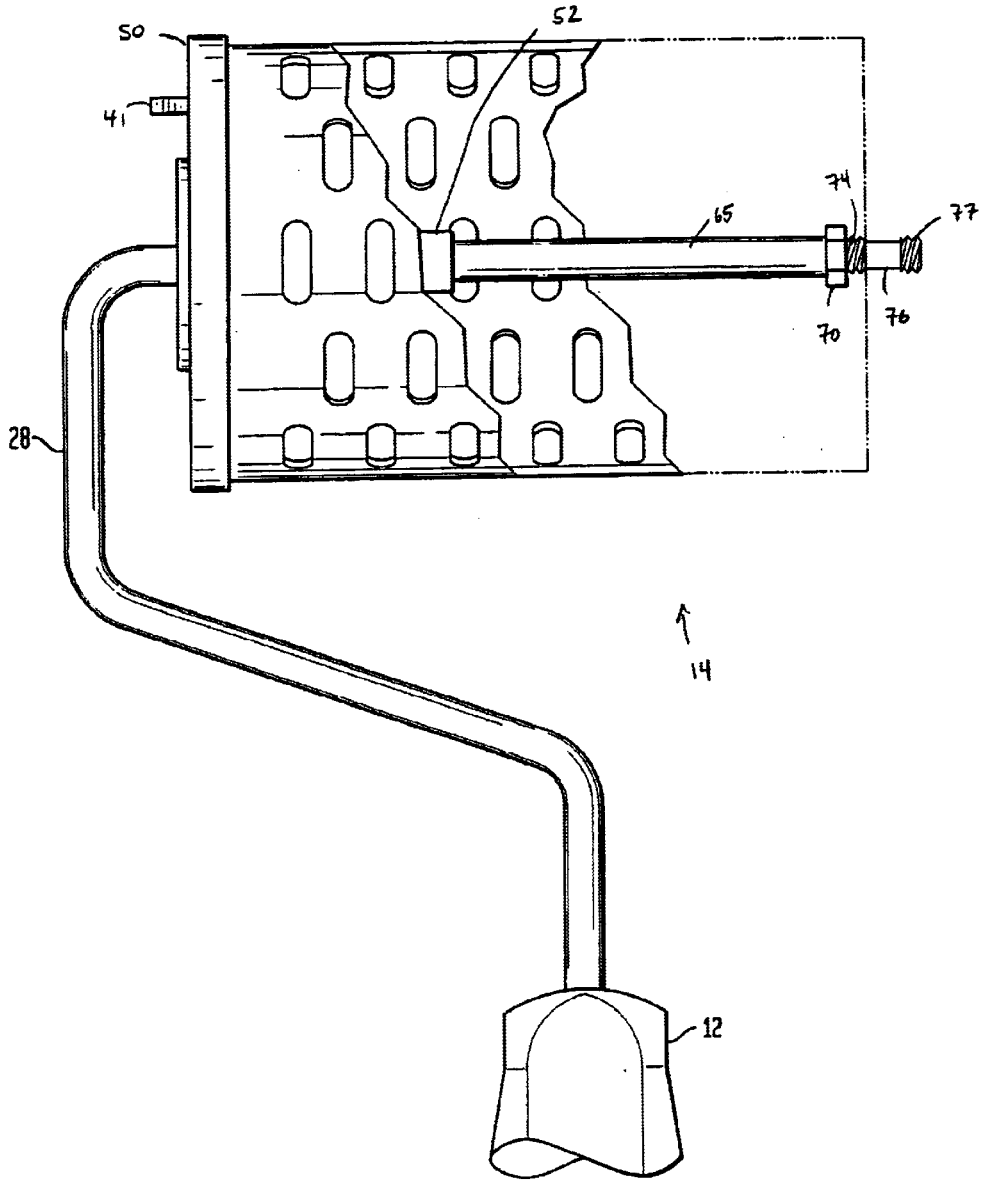
FIG. 9 depicts a paint roller in accordance with a second embodiment of the present invention in a partial cutaway view.

Although the paint roller 10 of the present invention has been described with respect to its preferred embodiment, other embodiments have been contemplated. For example, FIG. 2 depicts a paint roller 10 in accordance with a second embodiment wherein like numerals are used to describe like parts of the preferred embodiment. As shown in FIG. 2, the paint roller 10 includes a handle 12, an outer roller 14 and an inner roller 16. The outer roller 14 has a plurality of openings 18 in its cylindrical outer surface 20. Likewise, the inner roller 16 has a plurality of openings 22 in its cylindrical outer surface 24. Operation of these openings with respect to the degree of overlap is entirely consistent with the operation described with respect to the preferred embodiment, including the use of the stopper ring 36 and stopper 38 to control rotation thereof.

Where the second embodiment differs significantly from the preferred embodiment is with regard to the connection of the outer roller 14, inner roller 16 and end cap 90' to the handle 12. In this regard, the threaded end 34 of the shaft 30 of the second embodiment preferably includes a first threaded section 77 and a second threaded section 74 separated by a channel 76. The nut 70 utilized to attach the outer roller 14 to the handle 12 is adapted to be threaded on the second threaded section 74 such that the first threaded section 77 remains exposed. As shown in FIG. 9, the exposed threads 77 of the shaft 30 lie beyond the open end 51 of the outside roller 14.

The conical section 52 of outer roller 14 extends only about one-third of the way into reservoir 60. Hollow shaft 65 is fitted over shaft 30 and abuts conical section 52. Nut 70 is utilized to secure the outer roller 14 and hollow shaft 65 in this position, by its threaded engagement with second threaded section 74. End cap 90' may then be retained by a friction fit as described hereinafter.

Figure 11:
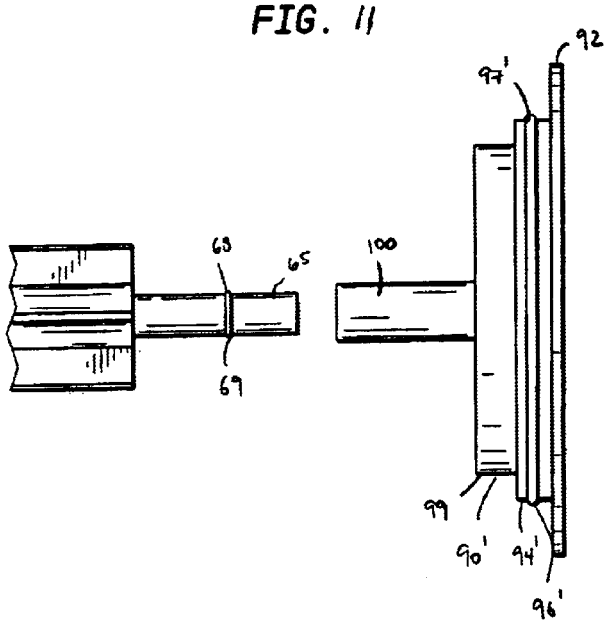
FIG. 11 illustrates an exploded side elevational view of the end cap of the paint roller in accordance with the second embodiment of the present invention.
Figure 12:
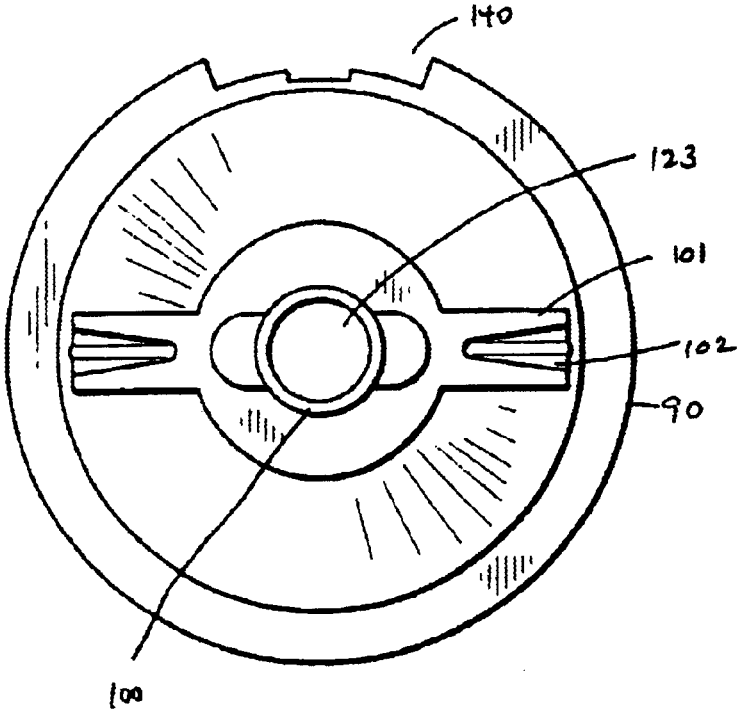
FIG. 12 depicts a rear elevational view of the end cap of the paint roller in accordance with the first embodiment of the present invention.
Figure 13:
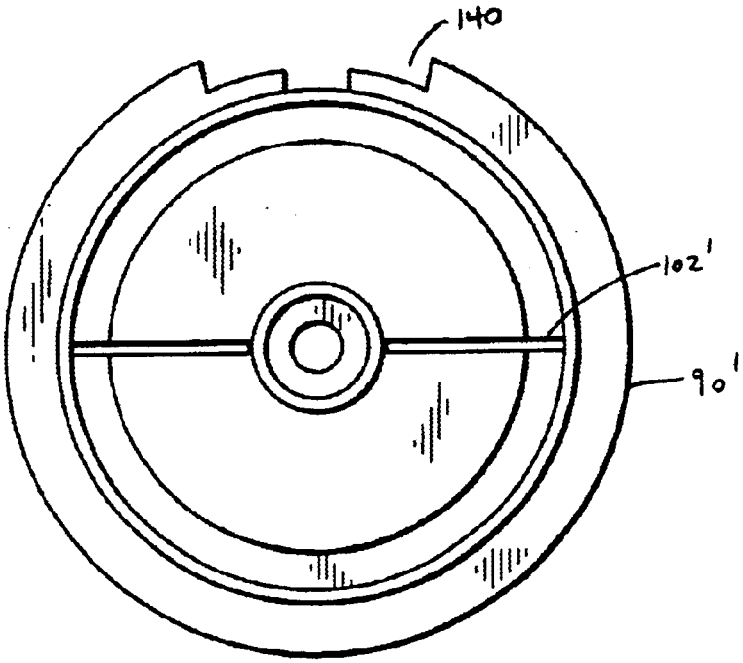
FIG. 13 depicts a rear elevational view of an end cap of the paint roller in accordance with the second embodiment of the present invention.

Portions of FIG. 2 and FIG. 11 depict an end cap 90' in accordance with the second embodiment of the present invention. The end cap 90' is preferably constructed from a single piece of plastic, but has several sections. The end cap 90' includes a first section 92' that has a diameter that is preferably greater than the diameter of the outer roller section 14. A second section 94' of the integrally formed end cap 90' has a diameter that is essentially the same as the inner diameter of the inner roller section 16, such that the section 94' fits snugly within the inner roller section 16 in a friction fit to retain the end cap on the roller 10. The second section 94' preferably includes a groove 96' in which a rubber O-ring 97' provides a seal between the end cap 90' and the inner roller section 16 that prevents paint 62 (not shown) from escaping the reservoir 60. A third section 99' extends from the second section 94'. Unlike the third section of the end cap 90 of the preferred embodiment of the present invention, the third section 99' of this end cap is of constant diameter rather than conical in shape. As shown in FIG. 11, the third section 991 includes a pair of channels 102' extending outward from its center. Each channel 102' is preferably sized to receive one of the elongated agitator blades 73 of the inner roller 16 to assist with rotation of the inner roller 16 relative to the outer roller 14, as previously described with respect to the first embodiment. A fourth, tube-like section 100' extends from the third section 99'.

The fourth section 100' is adapted to engage the hollow shaft 65 and O-ring 68. This snug friction fit of the tube-like fourth section 100' with the hollow shaft 65 and O-ring 68 that fits in channel 69 of the hollow shaft 65 provides a seal that prevents paint 62 (not shown) from escaping the reservoir 60 when the end cap 90' is placed on the paint roller 10. It will be appreciated that the hollow shaft 65 may be provided with O-ring 68, as shown in FIG. 11, or without O-ring 68 as shown in FIG. 9. Typically, however, O-ring 68 will be provided.

As previously stated, connection of end cap 90' of the second embodiment to the paint roller 10 is by way of friction fit. More specifically, section 94' and O-ring 97' fit snugly within the inner roller section 16. This friction fit is strong enough to retain paint 62 (not shown) within the reservoir 60. Because the end cap 90' of the second embodiment makes no inherent provisions for filling of the reservoir 60 with paint 62 (not shown), it must be completely removed to perform this task. Removal is achieved simply by pulling the end cap 90' from the paint roller 10. End cap 90' is provided with external walled sections 128' expressly for the purpose of enabling a user to grasp the end cap 90'.

If so desired, end cap 90' may be further secured by nut 70'. In this regard, nut 70' will be threadedly engaged on the first threaded section 77 following installation of end cap 90'. It will be appreciated that although this may provide a more secure connection for end cap 90', it has the disadvantage of making it more difficult to fill the paint roller 10 with paint. Notwithstanding, when this method is used, removal of end cap 90' is achieved by unthreading nut 70' from the first threaded section 77 and pulling end cap 90' from the paint roller 10.

Once the paint roller 10 of either embodiment has been assembled as discussed herein, and paint 62 (not shown) has been inserted into the reservoir 60 and sealed by end cap 90 or 90', a paint applicator cover 110 can be slid over the outer roller section 14. The paint applicator cover 110 is well known in the art, and is preferably constructed from conventional materials. The purpose of the paint applicator cover 110 is to make the application of the paint 62 to an object more aesthetically pleasing and more efficient.

Figure 14:
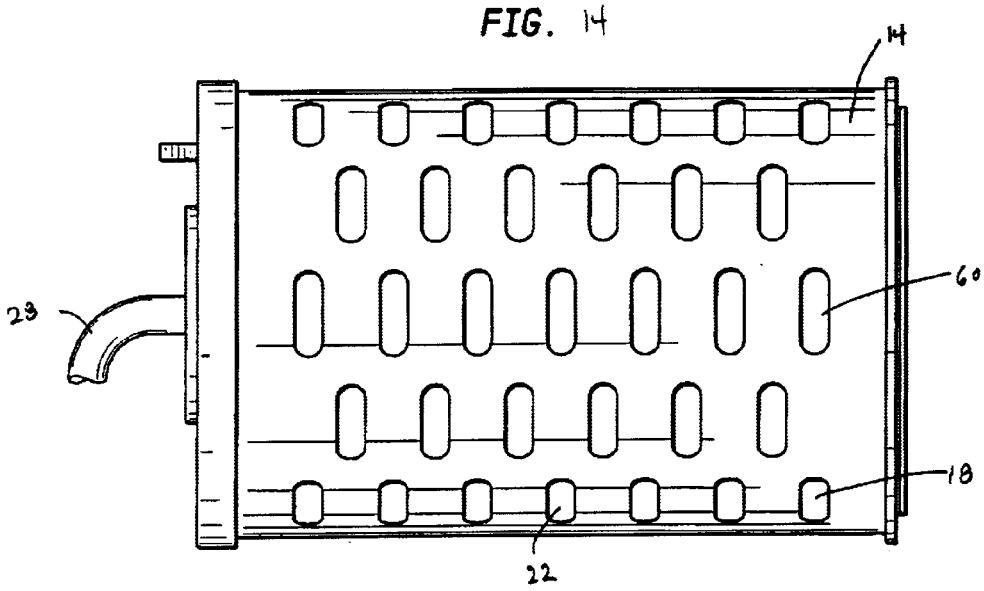
FIG. 14 illustrates the interface of the outer roller and the inner roller of the present invention wherein each roller's respective apertures are in complete registration.
Figure 15:
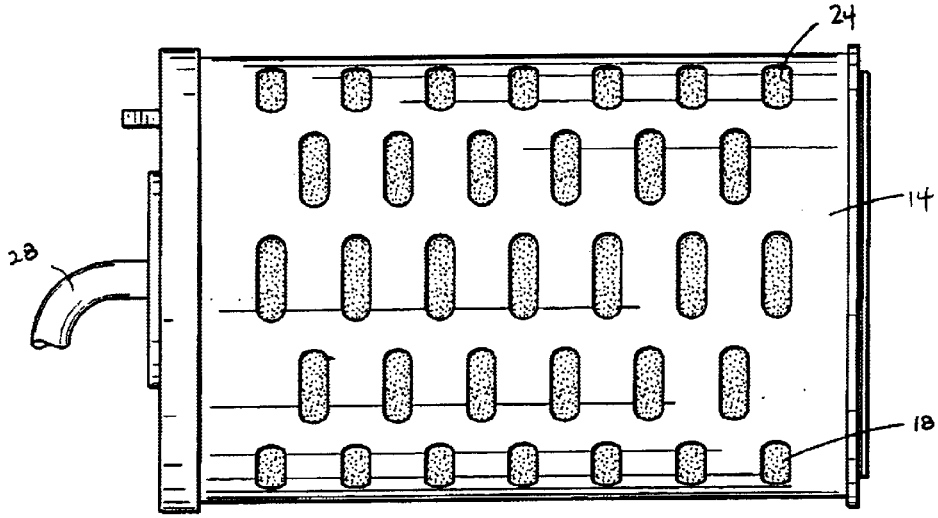
FIG. 15 depicts the interface of the outer roller and the inner roller of the present invention wherein the respective apertures of each roller are not in registration.
Figure 16:
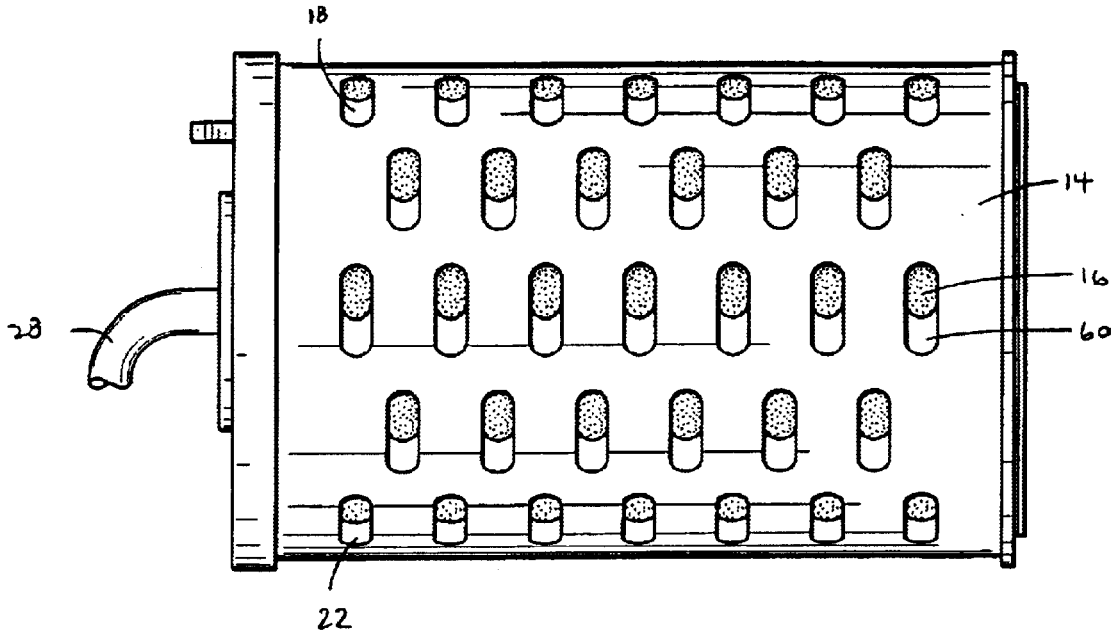
FIG. 16 depicts the interface of the inner roller and the outer roller of the present invention wherein the respective apertures are in partial registration.

Referring to FIGS. 14 to 16, the outer roller section 14 is illustrated on the bar 28, without any paint applicator cover 110 being placed over the outer roller section 14 so the interaction between openings 18 and 20 may be better seen. Thus, some of the plurality of openings 18 in the cylindrical surface 20 of the outer roller section 14 can be seen in FIG. 9. In FIG. 14, the outer roller section 14 is rotated relative to the inner roller section 16 so that each of the plurality of openings 18 in the outer roller section 14 align completely or fully with one of the plurality of openings 22 in the inner roller section 16. Thus, the external exposure of reservoir 60 from within the paint roller 10 is at its maximum in FIG. 14, allowing the maximum amount of paint (not shown) to be dispersed from the paint roller 10 when the paint roller is in use.

In FIG. 15, the outer roller section 14 is rotated relative to the inner roller section 16 so that there is no alignment between any of the plurality of openings 18 in the outer roller section 14 and any of the plurality of openings 22 in the inner roller section 16. Thus, the outer cylindrical surface 24 of the inner roller section 16 is visible through each of the plurality of openings 18 in the outer roller section 14. In this position, there is no opening from the reservoir 60 within the paint roller 10 to outside the paint roller 10, and no paint will be dispersed by the paint roller 10.

In FIG. 16, the outer roller section 14 is rotated relative to the inner roller section 16 so that there is a partial alignment between each of the plurality of slotted openings 18 in the outer roller section 14 and one of the plurality of slotted openings 22 in the inner roller section 16. The partial alignment results from a portion of one of the openings 22 in the inner roller section 16 being aligned with a portion of one of the openings 18 in outer roller section 14. Thus, in FIG. 16, only a portion of the outer cylindrical surface 14 of the inner roller section 16 is visible through each of the openings 18 in the outer roller section 14. The alignment of the openings can be adjusted by the rotation of the inner roller section 16 relative to the outer roller section 14, such that the alignment ranges from no alignment to partial alignment to full alignment in varying degrees. This alignment in varying degrees allows that amount of paint being dispersed by the paint roller 10 to be metered in preferred embodiments.

Figure 17:
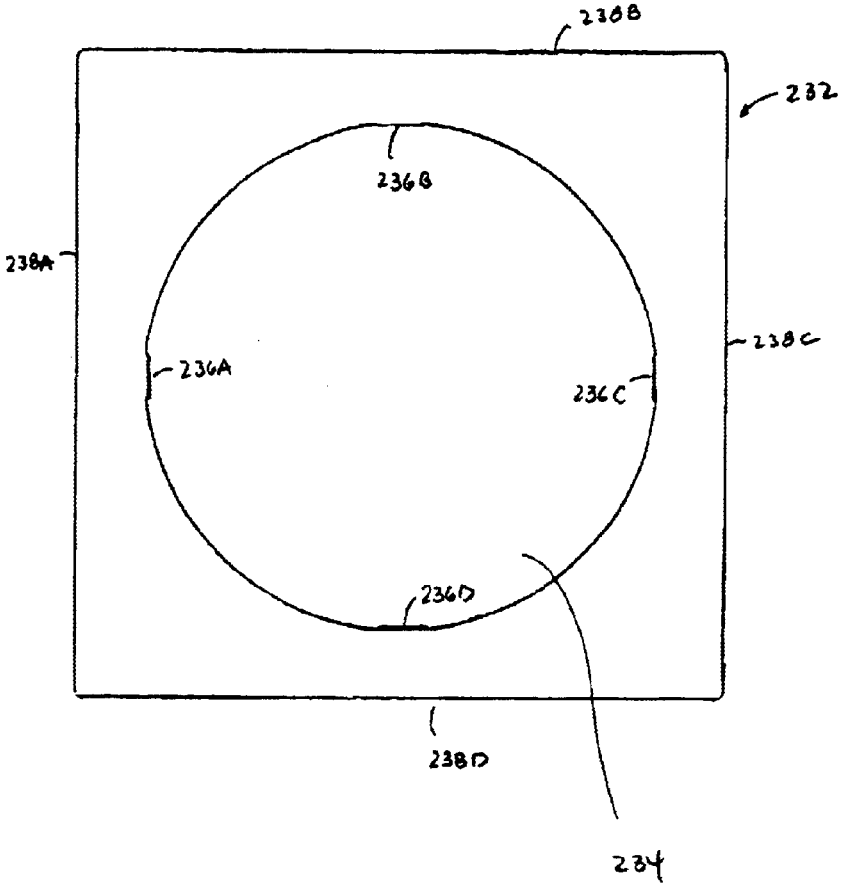
FIG. 17 illustrates a frontal elevational view of an edger utilized with the first embodiment of the present invention.
Figure 18:
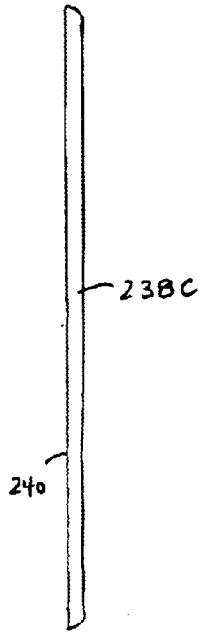
FIG. 18 depicts a side elevational view of the edger of FIG. 17.

An edger 232 designed to be used with the paint roller 10 of the first embodiment of the present invention is illustrated in FIGS. 17 and 18. The edger 232 is a relatively thin, square-shaped object with a large hole 234 therethrough. It is typically made from plastic, but may be made from other materials. The edger is generally used when the paint roller 10 is utilized to paint against an edge, such as a door jam or window frame. For such use, the edger's hole 234 is provided with four protrusions 236 A–D. The protrusions 236 A–D are generally spaced equally around the circumference of the hole 234, and protrude towards its center. The hole 234 is placed over the first section 93 of the integrally formed end cap 90 to be held in place by a pressure fit against the surface 53, such that the protrusions 236 A–D are retained within notch 93. Each of the edger's four edges 238 A–D, when measured perpendicularly therefrom, will have dimensions approximately equal to the diameter of the paint roller. This permits paint to be applied directly onto the intended surface, while the side surface is protected from paint application.

As shown in FIG. 18 with respect to edge 238C, each edge 238 A–D is slightly tapered towards the outer edger 240. When installed, the edger is placed on the paint roller 10 such that the outer edge 240 faces away from the paint roller 10. In this embodiment, the edger 232 may remain in place while the paint roller 10 is being filled with paint 62.

Figure 19A:
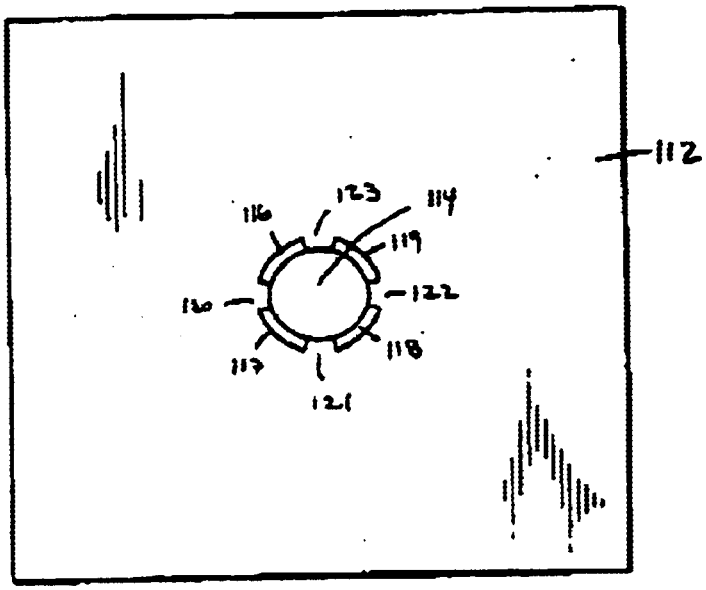
FIG. 19A illustrates a frontal elevational view of an edger utilized with the second embodiment of the present invention.
Figure 19B:
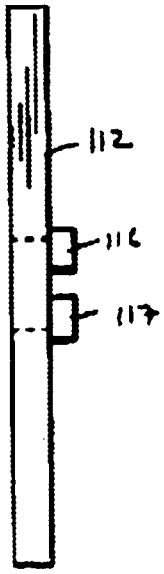
FIG. 19B depicts a side elevational view of the edger of FIG. 19A.
Figure 20:
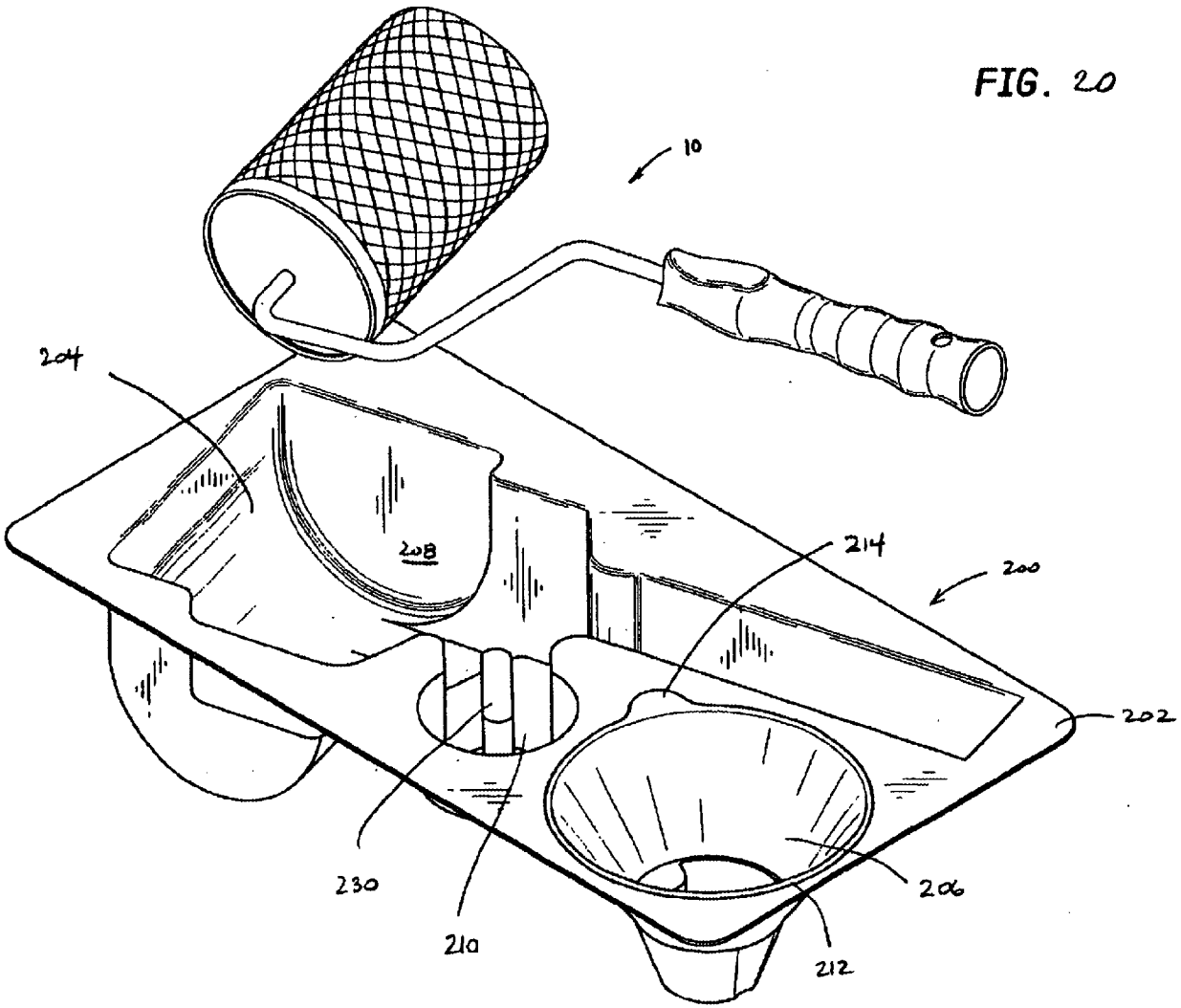
FIG. 20 depicts an exploded perspective view of a roller unit and tray system in accordance with the present invention.

The edger 112 designed to be used with the paint roller 10 of the second embodiment of the present invention is illustrated in FIGS. 19 and 20. Like edger 232, the edger 112 has a hole 114. The edger 112 is typically made of plastic, but may be formed from other material. The edger 112 has four walls 116, 117, 118 and 119 extending from one side. There are four slotted areas 120, 121, 122 and 123 created by the four walls 116–119. The edger 112 is placed onto the paint roller 10 of the second embodiment of the present invention such that the walls 116–119 are towards the end cap 90' and such that the flat surface, of the edger 112 is on the outside. The hole 114 fits onto the end of the shaft 30 in a friction fit to keep the edger 112 on the paint roller. In this embodiment, the edger 112 must first be removed from the paint roller 10 prior to filling of the paint roller with paint 62.

It will be appreciated that the paint roller of the present invention may be provided in a variety of dimensions. Ideally, those dimensions equal those normally provided for paint rollers of the prior art. For example, the paint roller may have an outer roller section 14 that is approximately 7 inches long and 2.25 inches in diameter. The paint roller may also have an outer roller section 14 that is approximately 4.5 inches long and 3 inches in diameter. These dimensions are identical to those typically found in the industry, and will generally be most comfortable for the average user. Again, however, any other combination of dimensionally stable sizes may be utilized.

Also included in the paint rolling system is a tray 200, shown in FIG. 20. The tray contains a mostly flat upper surface 202, a first recess 204, and a second recess 206. The tray is typically molded from plastic, though other thin yet strong materials may be used, including sheet metal, aluminum, or the like. The tray 200 primarily serves two purposes.

The first purpose of the tray is to provide storage for the paint roller 10 and all of its appurtenances including the edger 232 or 112, and paint applicator cover 110. Accordingly, the first recess 204 includes an elongated main section 208 which is registered to the size and shape of the paint roller 10 so as to conveniently store the paint roller completely within. Once the paint roller 10 is placed within the first recess 204, the paint applicator cover 110 and the edger 232 or 112 may also be placed within the first recess 204. It will be appreciated that these secondary items are placed in the first recess 204 rather loosely, as the recess is not configured to accept their particular shapes snuggly, as is the case with paint roller 10.

Figure 21:
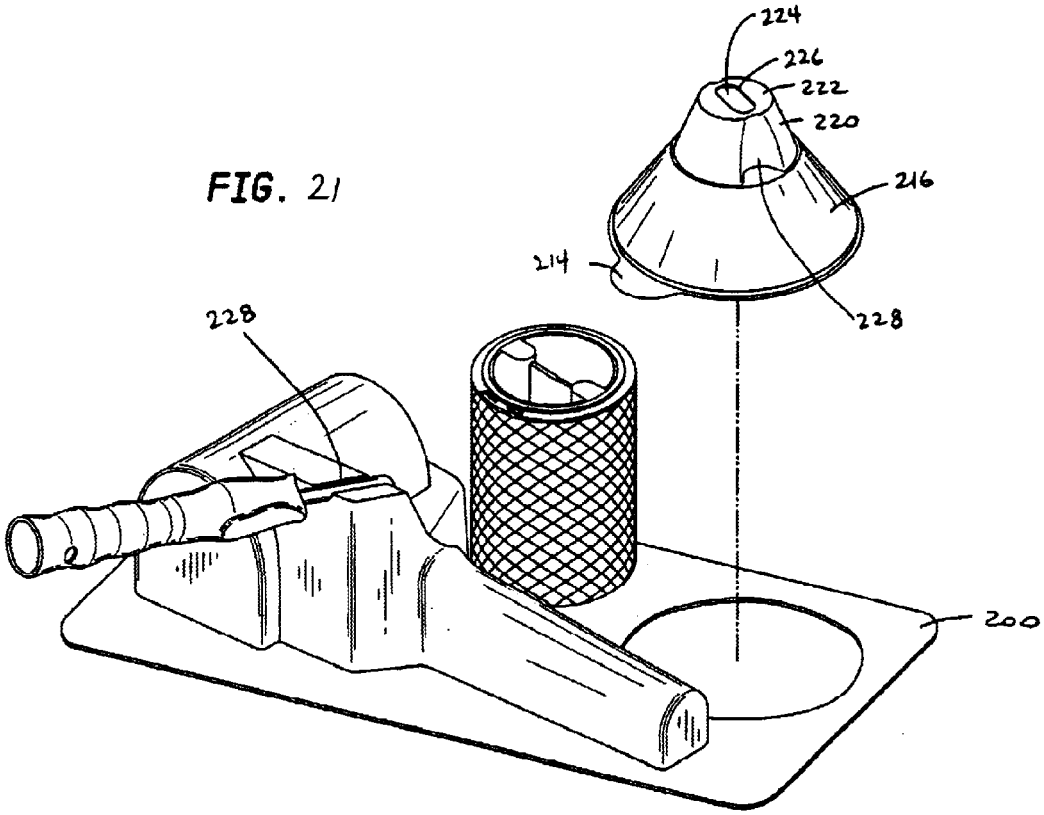
FIG. 21 depicts a partially exploded perspective view of the initial steps of the method of utilizing the underside of the tray to fill the paint roller of the present invention with paint.

The second purpose of the tray 202 is to facilitate filling of the paint roller 10 with paint 62. As shown in FIG. 21, when used for this purpose, the tray 200 is flipped over such that the flat upper surface 202 becomes the base. It will be appreciated that when the cover 200 is placed in such a manner, first recess 204 and second recess 206 extend upwardly from the surface in which the cover 200 rests, rather than downwardly as before.

Before flipping over the tray 200, the second recess 206 may be removed from the tray 200. In order to facilitate such removal, a score line 212 is provided on the cover 200 to define the second recess 206. The score line 212 is generally circular but includes a tab 214. The score line is an area where the tray 200 is weakened locally by crimping, creasing, perforating or any other suitable method such that the second recess 206 may be easily removed from the remainder of the tray 200, but is retained prior to such intervention. The second recess 206, when removed from the tray 200, is utilized as a funnel to assist with the filling of the reservoir 60 of the paint roller 10. In this regard, the second recess 206 includes a first section 216 which is generally conical in shape and extends from the perforated line 212. Extending outwardly from the first section 216 is a second section 220. The second section is also generally conical in shape, but has sidewalls that correspond to the third section 98 of end cap 90. The second section ends with a flat portion 222. The flat portion 222 includes a score line 226. It is intended that the user cut the flat portion along the score line to create an aperture 224. The second section 220 of the second recess 206 also includes a pair of indents 228. As will be described hereinafter, the second recess 206 is utilized as a funnel to assist with the filling of the paint roller 10 with paint 62 (not shown).

In order to fill the paint roller 10 with paint 62, (not shown) the metal bar 28 is placed within a groove 228 located within the first recess 204. Another portion of the metal bar 28 is placed in a groove 230 located within the secondary portion 210 of the first recess 204. It will be appreciated that the secondary portion 210 of the first recess 204 is generally shaped to matingly engage the walled end 50 of the outer roller 14. Once the paint roller 10 is placed in such a manner, it is highly stable and nearly ready to accept paint 62 (not shown).

Figure 22:
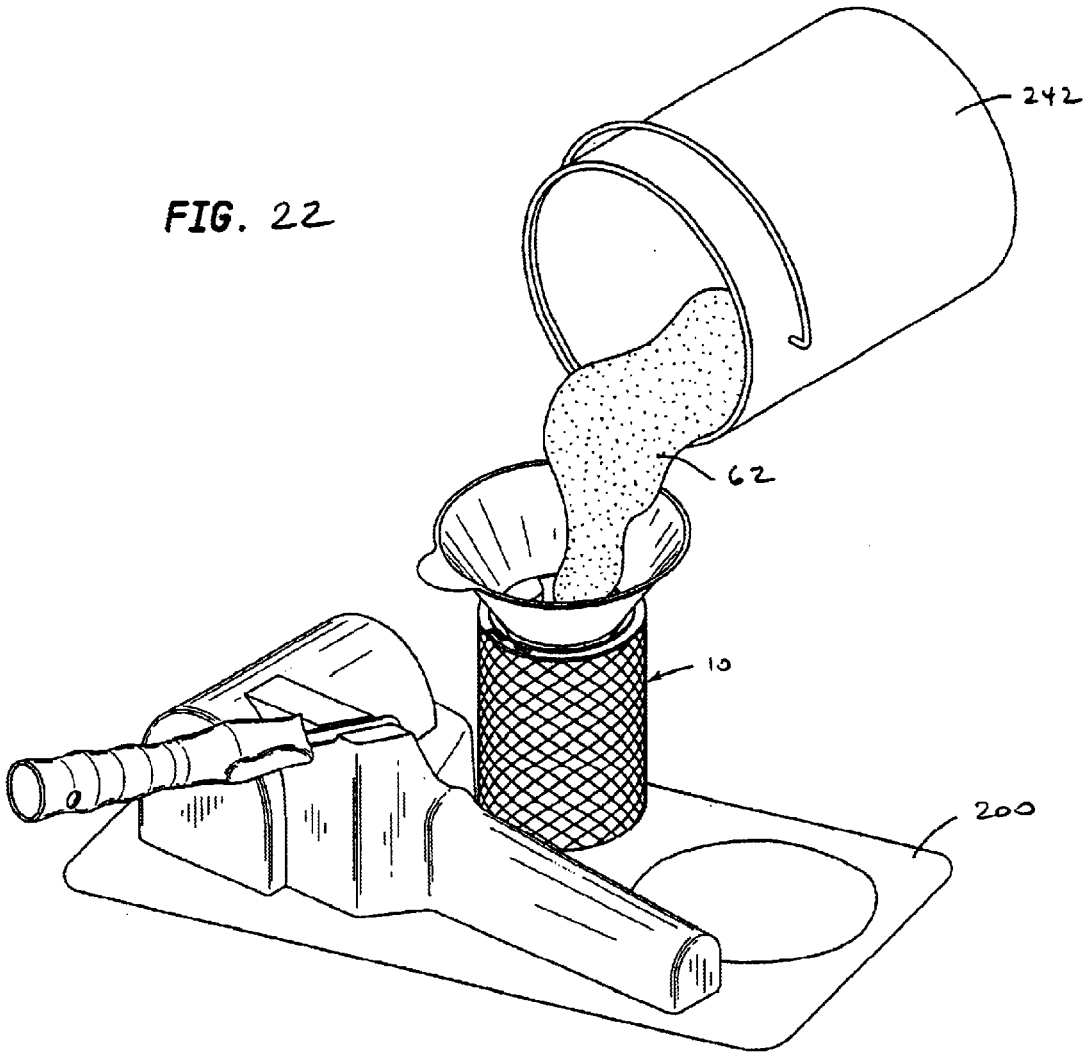
FIG. 22 depicts a perspective view of a subsequent step in the method of filling the paint roller of the present invention with paint.

With specific regard to the first embodiment, the paint roller 10 may be filled with paint 62 (not shown) by removing the end cap cover 120. Once the end cap cover 120 is removed, the second recess 206 forming a funnel may be placed within the end cap 90 such that the indents 228 matingly engage the wing-like protrusions 128, as shown in FIG. 22. If the score line 226 has been cut to reveal aperture 224, it will be appreciated that an opening through to the reservoir 60 will have been created such that paint 62 may be easily placed therein. Tab 214 may be held by the digits of a human hand during the paint filling process to further stabilize the funnel formed from the second recess 206. As shown in FIG. 15. However, this may not be necessary.

Figure 23:
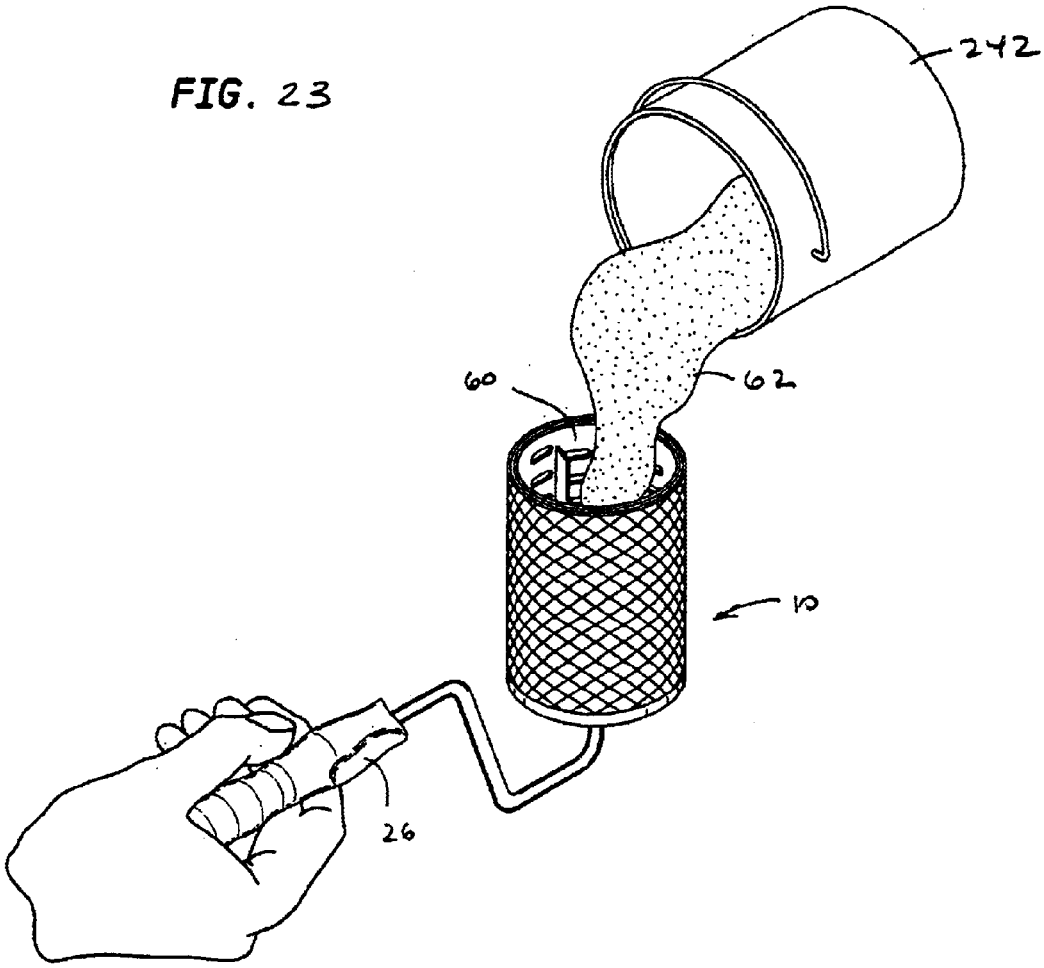
FIG. 23 depicts a perspective view of a second method of filling the paint roller of the present invention with paint.

FIG. 23 depicts an additional method of filling a paint roller 10 with paint 62. In the method down by FIG. 16, paint 62 may be spilled directly from a paint can 242 into the roller 16 while the handle 26 is being held by a user. The paint roller 10 shown in FIG. 23 is in accordance with the second embodiment of the present invention. In the second embodiment, in order to fill the reservoir 60 with paint 62, the end cap 90' must be completely removed from the paint roller 10. It will be appreciated that the method shown in FIG. 23 may also be practiced with the paint roller 10 in accordance with the first embodiment of the present invention. In this regard, paint 62 may be spilled directly into the end cap 90 after the end cap cover 120 is removed. Finally, the funnel formed from the second recess 206 of the tray 200 may also be used with the first embodiment of the present invention to assist with the depositing of paint 62 within the reservoir 60 using this method.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A painting tool for dispensing paint, comprising:

a handle;

an outer roller section connected to the handle, the outer roller section having a cylindrical surface with a plurality of openings, a closed end and an open end;

an inner roller section having a cylindrical surface with a plurality of openings, the inner roller section fitting concentrically within the outer roller section;

a cap enclosing said open end of said outer roller section said cap having an aperture; and, an end cap cover;

wherein the outer roller section and the inner roller section may be rotated relative to each other so that each of the plurality of openings in the cylindrical surface of the outer roller section adjusts from non-alignment to full alignment with at least one of the plurality of openings in the cylindrical surface of the inner roller section and said cap fits inside the inner roller section in a friction fit and further comprises a seal that fits between the cap and the inner section, said end cap cover being fitted to matingly engage said end cap in said aperture to prevent paint from leaking out of said reservoir.

2. The painting tool of claim 1, wherein the degree of alignment between the openings in the cylindrical surface of the outer roller section with the openings of the cylindrical surface of the inner roller section depends on the relative position of the outer roller section as compared to the inner roller section.

3. The painting tool as claimed in claim 1, wherein the inner roller section forms a reservoir inside the painting tool, wherein paint may be deposited inside the reservoir and can be dispensed outside the painting tool at a rate determined by the alignment of the openings of the cylindrical surface of the outer roller section and the openings of the cylindrical surface of the inner roller section.

4. The painting tool as claimed in claim 3, wherein said reservoir further comprises a plurality of agitator blades for mixing the paint therein when the painting tool is in use.

5. The painting tool as claimed in claim 1, further comprising a paint applicator that fits around the cylindrical section of the outer roller section.

6. The painting tool as claimed in claim 1, further comprising an edger that can be attached to the painting tool.

7. The painting tool as claimed in claim 5, wherein the edger has at least one straight edge.

8. The painting tool as claimed in claim 1, wherein the outer roller section and the inner roller section can rotate in tandem relative to the handle.

9. The painting tool as claimed in claim 1, wherein:

said handle further comprises a shaft extending through a reservoir formed by the outer roller section and the inner roller section; and said outer roller section has a closed end and a conical structure fitting around a portion of the shaft extending through the reservoir.

10. The painting tool as claimed in claim 9, wherein said conical structure includes a plurality of agitator blades extending into the reservoir.

11. The painting tool as claimed in claim 1, further comprising a slot in the outer roller section and a knob in the inner roller section, the knob sliding in the slot to control the amount of relative rotation between the outer roller section and the inner roller section.

12. A painting tool for dispensing paint, comprising:

a handle;

an outer roller section connected to the handle, the outer roller section having a cylindrical surface with a plurality of openings and an open end;

an inner roller section having a cylindrical surface with a plurality of openings, the inner roller section fitting concentrically within the outer roller section;

a cap, said cap enclosing said open end of said outer roller section; and an end cap cover, said end cap cover being fitted to matingly engage said cap;

wherein the outer roller section and the inner roller section can be rotated relative to each other so that each of the plurality of openings in the cylindrical surface of the outer roller section align in varying degrees with at least one of the plurality of openings in the cylindrical surface of the inner roller section.

13. The painting tool as claimed in claim 12, wherein the degree or alignment of the openings ranges from no alignment to partial alignment to complete alignment.

14. The painting tool as claimed in claim 12, further comprising a paint applicator that fits around the cylindrical section of the outer roller section.

15. The painting tool as claimed in claim 12, further comprising an edger that can be attached to the painting tool.

16. A painting tool for dispensing paint, comprising:

a handle;

a roller section connected to the handle such that the roller section rotates relative to the handle, the roller section having a cylindrical surface that includes a plurality of openings and an open end;

a reservoir inside the roller section that can hold paint;

a cap enclosing said open end of said roller section, said cap adapted to fit within the open end of said roller section in a friction fit; and an edger capable of being attached to the painting tool;

wherein said cap includes an aperture, said painting tool further comprising a cap cover which may matingly engage said cap to prevent paint from escaping said reservoir.

17. The painting tool as claimed in claim 16, further comprising means for controlling the size of the plurality of openings in the cylindrical surface.

18. The painting tool as claimed in claim 17, further comprising a plurality of agitator blades located inside the reservoir.

19. The painting tool as claimed in claim 16, further comprising a paint applicator cover that fits around the roller section.

20. The painting tool as claimed in claim 16, further comprising at least one agitator blade located within the reservoir.

21. The painting tool as claimed in claim 16, further comprising an inner roller section that fits concentrically inside the roller section, the inner roller section having a cylindrical surface with a plurality of openings, wherein the roller section and the inner roller section can be rotated relative to each other so that each of the plurality of openings in the cylindrical surface of the roller section align with one of the plurality of openings in the cylindrical surface of the inner roller section in varying degrees depending on the relative position of the roller section to the inner roller section.

22. The painting tool as claimed in claim 21, wherein paint is contained inside the reservoir and the paint is dispensed from the painting tool at a rate determined by the relative position of the roller section to the inner roller section.

23. The painting tool as claimed in claim 21, further comprising at least one slot in the roller section and at least one knob on the inner roller section, each of the knobs sliding in one of the slots.

24. The painting tool as claimed in claim 16, wherein the edger has at least one straight edge.

25. The painting tool as claimed in claim 16, wherein the roller section and the inner roller section can rotate together relative to the handle.

26. The painting tool as claimed in claim 16, further comprising:

the handle having a section extending through a reservoir formed by the roller section and the inner roller section;

the roller section having a closed end and a conical structure fitting around the section extending through the reservoir, the conical structure having a plurality of agitator blades extending into the reservoir.

27. A painting tool for dispensing paint, comprising:

a handle;

an outer roller section connected to the handle, the outer roller section having a cylindrical surface with a plurality of openings, a closed end and an open end;

an inner roller section having a cylindrical surface with a plurality of openings, the inner roller section fitting concentrically within the outer section;

a cap enclosing said open end of said outer roller section, said cap having an aperture; and, an end cap cover;

wherein the outer roller section and the inner roller section may be rotated relative to each other so that each of the plurality of openings in the cylindrical surface of the outer roller section adjusts from non-alignment to full alignment with at least one of the plurality of openings in the cylindrical surface of the inner roller section, said handle further comprising a shaft extending through a reservoir formed by the outer roller section and the inner roller section; and said outer roller section having a closed end and a conical structure fitting around a portion of the shaft extending through the reservoir, said conical structure including a plurality of agitator blades extending into the reservoir.

28. The painting tool of claim 27, wherein the degree of alignment between the openings in the cylindrical surface of the outer roller section with the openings of the cylindrical surface of the inner roller section depends on the relative position of the outer roller section as compared to the inner roller section.

29. The painting tool as claimed in claim 27, wherein the inner roller section forms a reservoir inside the painting tool;

wherein paint may be deposited inside the reservoir and can be dispensed outside the painting tool at a rate determined by the alignment of the openings of the cylindrical surface of the outer roller section and the openings of the cylindrical surface of the inner roller section.

30. The painting tool as claimed in claim 29, wherein said reservoir further comprises a plurality of agitator blades for mixing the paint therein when the painting tool is in use.

31. The painting tool as claimed in claim 27, further comprising a paint applicator that fits around the cylindrical section of the outer roller section.

32. The painting tool as claimed in claim 27, further comprising an edger that can be attached to the painting tool.

33. The painting tool as claimed in claim 32, wherein the edger has at least one straight edge.

34. The painting tool as claimed in claim 27, wherein the outer roller section and the inner roller section can rotate in tandem relative to the handle.

35. The painting tool as claimed in claim 27, further comprising a slot in the outer roller section and a knob in the inner roller section, the knob sliding in the slot to control the amount of relative rotation between the outer roller section and the inner roller section.

36. A painting tool for dispensing paint, comprising:

a handle;

a roller section connected to the handle such that the roller section rotates relative to the handle, the roller section having a cylindrical surface that includes a plurality of openings;

a reservoir inside the roller section that can hold paint, the handle having a section extending through the reservoir; and an edger capable of being attached to the painting tool;

wherein the roller section includes a closed end and a conical structure fitting around the section extending through the reservoir, the conical structure having a plurality of agitator blades extending into the reservoir.

37. The painting tool as claimed in claim 36, further comprising means for controlling the size of the plurality of openings in the cylindrical surface.

38. The painting tool as claimed in claim 37, further comprising a plurality of agitator blades located inside the reservoir.

39. The painting tool as claimed in claim 36, further comprising a paint applicator cover that fits around the roller section.

40. The painting tool as claimed in claim 36, further comprising at least one agitator blade located within the reservoir.

41. The painting tool as claimed in claim 36, further comprising an inner roller section that fits concentrically inside the roller section, the inner roller section having a cylindrical surface with a plurality of openings, wherein the roller section and the inner roller section can be rotated relative to each other so that each of the plurality of openings in the cylindrical surface of the roller section align with one of the plurality of openings in the cylindrical surface of the inner roller section in varying degrees depending on the relative position of the roller section to the inner roller section.

42. The painting tool as claimed in claim 41, wherein paint is contained inside the reservoir and the paint is dispensed from the painting tool at a rate determined by the relative position of the roller section to the inner roller section.

43. The painting tool as claimed in claim 41, further comprising at least one slot in the roller section and at least one knob on the inner roller section, each of the knobs sliding in one of the slots.

44. The painting tool as claimed in claim 36, wherein the edger has at least one straight edge.

45. The painting tool as claimed in claim 36, wherein the roller section and the inner roller section can rotate together relative to the handle.

46. The painting tool as claimed in claim 36, wherein the roller section includes a closed end and an open end, further comprising a cap that encloses the open end.

47. The painting tool as claimed in claim 46, wherein the cap fits inside the inner roller section in a friction fit and further comprising a seal that fits between the cap and the inner roller section.

48. The painting tool as claimed in claim 47, wherein said cap includes an aperture, said painting tool further comprising a cap cover which may matingly engage said cap to prevent paint from escaping said reservoir.

* * * * *

UNITED STATES PATENT AND TRADEMARK OFFICE

CERTIFICATE OF CORRECTION

PATENT NO. : 6,877,925 B2
DATED : April 12, 2005
INVENTOR(S) : Juan Fernandez

It is certified that error appears in the above-identified patent and that said Letters Patent is hereby corrected as shown below:

Title page,
Item [60], Related U.S. Application Data, "filed on Feb. 1, 2000" should read -- filed on Feb. 1, 2002 --.

Column 2,
Line 12, "patented" should read -- painted --.
Line 32, delete the comma after the word "portion".

Column 7,
Lines 30, 31, 35 and 36, "notched out" should read -- notched-out --.

Column 8,
Line 32, "991" should read -- 99' --.

Column 10,
Line 19, "FIGS. 19 and 20." should read -- FIGS. 19A and 19B. --.
Line 27, delete the comma after the word "surface".

Column 11,
Line 55, "down" should read -- shown --.

UNITED STATES PATENT AND TRADEMARK OFFICE

CERTIFICATE OF CORRECTION

PATENT NO. : 6,877,925 B2
DATED : April 12, 2005
INVENTOR(S) : Juan Fernandez

It is certified that error appears in the above-identified patent and that said Letters Patent is hereby corrected as shown below:

Column 12,
Line 22, insert a comma after the word "section" .
Line 59, "claim 5" should read -- claim 6 --.

Column 16,
Line 36, "comprising" should read -- comprises --.

Signed and Sealed this

Sixteenth Day of August, 2005

JON W. DUDAS
*Director of the United States Patent and Trademark Office*